United States Patent [19]

Komatsu et al.

[11] 4,312,269

[45] Jan. 26, 1982

[54] DOT PRINTING APPARATUS

[75] Inventors: Fumito Komatsu, Shiojiri; Kazuhiko Nakata, Higashioizumi; Junichiro Sinozaki, Chino; Eiichi Kazama; Hiroshi Morishige, both of Shimosuwa, all of Japan

[73] Assignee: Kabushiki Kaisha Sankyo Seiki Seisakusho, Nagano, Japan

[21] Appl. No.: 147,655

[22] Filed: May 7, 1980

[51] Int. Cl.[3] ..... B41J 3/08; B41J 3/12

[52] U.S. Cl. ..... 101/93.04; 400/121

[58] Field of Search ..... 400/121, 125, 163.1, 400/163.2, 163.3; 101/93.04, 93.23, 93.25, 93.47; 346/101

[56] References Cited

U.S. PATENT DOCUMENTS

| | | | |
|---|---|---|---|
| 1,520,089 | 12/1924 | Scherbius | 400/163.2 X |
| 1,971,859 | 8/1934 | Knutsen | 101/93.25 |
| 2,175,530 | 10/1939 | Knutsen | 101/93.25 |
| 2,799,221 | 7/1957 | Olivetti | 101/93.25 |
| 2,945,091 | 7/1960 | Canepa | 400/163.1 X |
| 3,647,356 | 3/1972 | Feder | 346/101 |
| 3,896,919 | 7/1975 | Hutley | 101/93.23 X |
| 3,973,488 | 8/1976 | Mielke | 101/93.04 X |
| 4,138,942 | 2/1979 | Hutley | 101/93.23 X |

FOREIGN PATENT DOCUMENTS

| | | | |
|---|---|---|---|
| 26940 | 11/1964 | Japan | 101/93.04 |

*Primary Examiner*—Paul T. Sewell

*Attorney, Agent, or Firm*—Sughrue, Mion, Zinn, Macpeak and Seas

[57] ABSTRACT

A printing apparatus for printing dots on a printing web comprises: a printer body frame; a single rotational drive motor for producing drive rotational force; rotational force transmission for transmitting the rotational force; a spring-biased link rotatable around a rotary shaft supported by the printer body frame; printing web feeding device; a printing drum having helical printing projections thereon, disposed so as to face the printing web, and supplied with the rotational force through the transmission at all times, the drum being rotatably mounted on the link; and an interlock including a transmission gear engaging with the drum and a ratchet gear engageable with a ratchet pawl pivotable in response to a solenoid to thereby achieve the printing shot by use of the single rotational drive motor when the solenoid is energized.

5 Claims, 5 Drawing Figures

DOT PRINTING APPARATUS

BACKGROUND OF THE INVENTION

The present invention relates to a printing apparatus for printing marks such as letters and figures on printing webs such as papers.

There has been heretofore provided a so-called printer for printing letters, figures and the like on materials such as printing papers. In such a prior art printing machine, a printing drum is driven by a suitable motor to align in printing positions the letters and the like to be printed and then a hammer disposed on an opposite side to the printing drum is driven by solenoid means to hit the drum thereby completing the print on the printing papers positioned between the hammer and the drum.

However, the prior art printing apparatus requires the motor to rotate the printing drum and also the solenoid means having a large capacity enough to drive the hammer. Accordingly, the apparatus is disadvantageous in that the structure thereof is intricate with a large size and a large amount of an electrical power is required to drive the solenoid means.

SUMMARY OF THE INVENTION

An object of the present invention is to provide a printing apparatus eliminating the above-noted drawbacks inherent to the prior art system, having a simple structure leading to a miniaturization, and having an extremely small amount of an electrical power to be expended.

Another object of the invention is to provide a novel printing apparatus having a simplified structure wherein a printing drum is supported to rotate and swing, utilizing a single drive motor.

A further object of the invention is to provide a printing apparatus enabling to feed a paper web synchronized with the single drive motor.

A still further object of the invention is to provide a printing apparatus wherein the line slant angle of the printed dotted marks is reduced to a negligible extent.

A still further object of the invention is to provide a printing apparatus ensuring the original position establishment by using a detecting switch.

These and other objects of the present invention will be achieved by the printing apparatus for printing marks on a printing web comprising: a printer body frame; a single rotational drive motor for producing drive rotational force; rotational force transmission means for transmitting the rotational force; spring-biased link means rotatable around a first rotary shaft supported by the printer body frame; printing web feeding means; a printing drum having helical printing projection thereon, disposed so as to face the printing web, and supplied with the rotational force through said transmission means at all times, said drum being rotatably mounted on said link means; and interlock means including a transmission gear engaging with said drum and a ratchet gear engageable with a ratchet pawl pivotable in response to solenoid means whereby by the transmitted rotational force derived from the drive motor said printing drum is rotated to abut against the printing web backed-up by said feeding means when the ratchet gear is operatively engaged with and slid on the ratchet pawl pivotally moved by the solenoid means.

BRIEF DESCRIPTION OF THE DRAWINGS

In the accompanying drawings.

DESCRIPTION OF PREFERRED EMBODIMENTS

Figure 1:
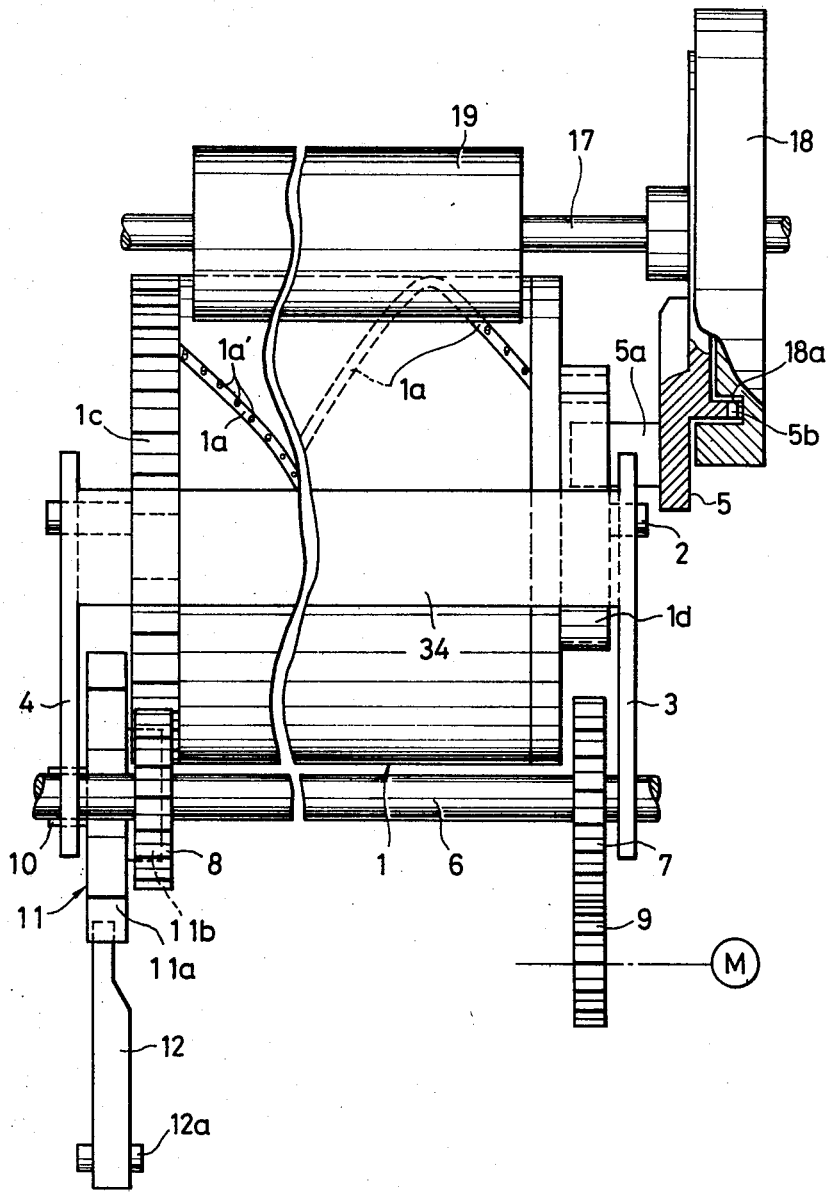
FIG. 1 is a plan view of the printing apparatus of the present invention, in which the printer outer body frame is omitted for a ready understanding.

The present invention will hereinafter be described with reference to the accompanying drawings. A printing drum designated generally by reference numeral 1 is rotatably supported through a shaft 2 by a pair of link members 3 and 4 which are coupled to each other through a plate 34. The drum 1 is provided with a strip-shaped projection 1*a* arranged in a helical manner. On the strip-shaped projections 1*a* are provided a number of dot projections 1*a'* each defining a printing point to thereby form letters or figures on the paper in combination. A gear 1*c* is secured to one side end of the printing drum, and a cam member 1*d* is secured to the other. A shouldered portion 1*d''* (FIG. 2) is formed in a cam surface 1*d'* which is formed inside of a peripheral wall of the cam member 1*d* and is engageable with an extension 5*a* of a paper feeding lever 5, the extension 5*a* having a semicircular cross section as shown by a dotted line in FIG. 2.

The above described link members 3 and 4 are rotatably mounted around a shaft 6 on which right and left transmission gears 7 and 8 are fixedly secured, respectively. The shaft 6 is rotatable but not movable with respect to the printer base frame (not shown). The right side gear 7 meshes with a drive gear 9 coupled to a suitable shaft cooperating with a motor M which is a drive source, whereas the left side gear 8 meshes with the gear 1*c* of the drum 1. Accordingly, as the motor M rotates, the rotational torque is transmitted through the drive gears 9 and the transmission gear 7, the shaft 6, the transmission gears 8 and the gear 1*c* of the drum in that order, to thereby rotate the printing drum 1.

Figure 2:
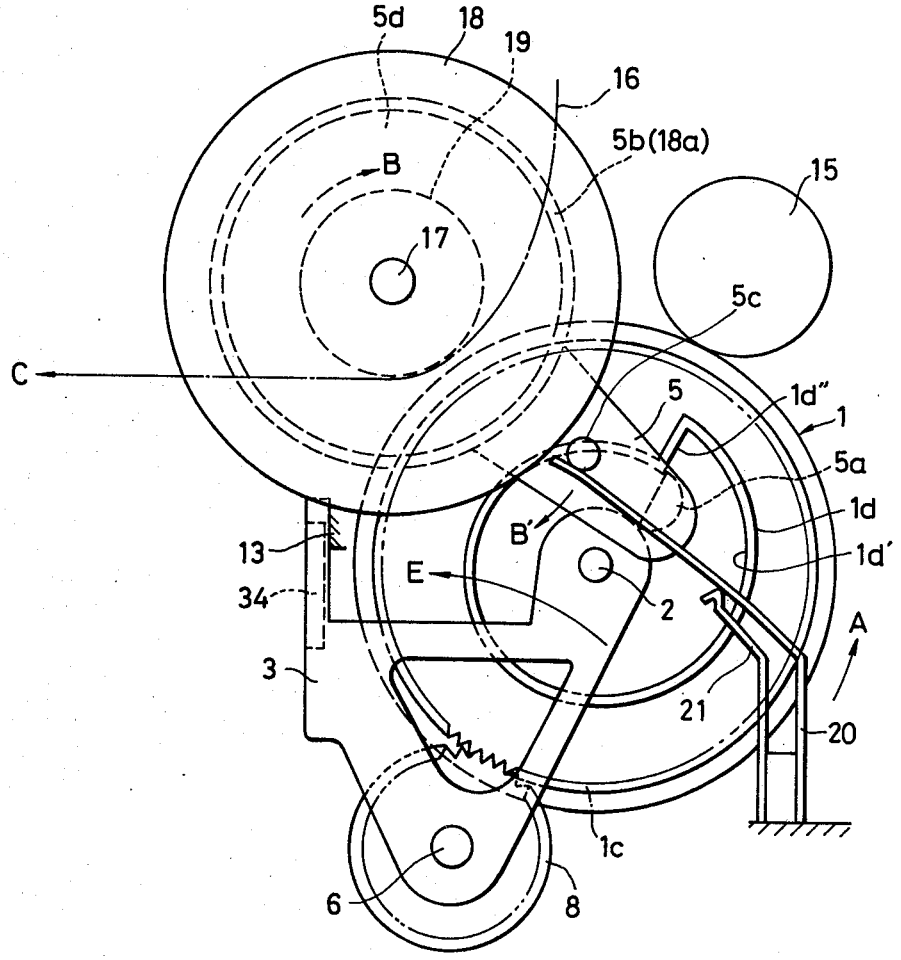
FIG. 2 is a side elevational view of the apparatus as viewed from the right of FIG. 1.
Figure 3:
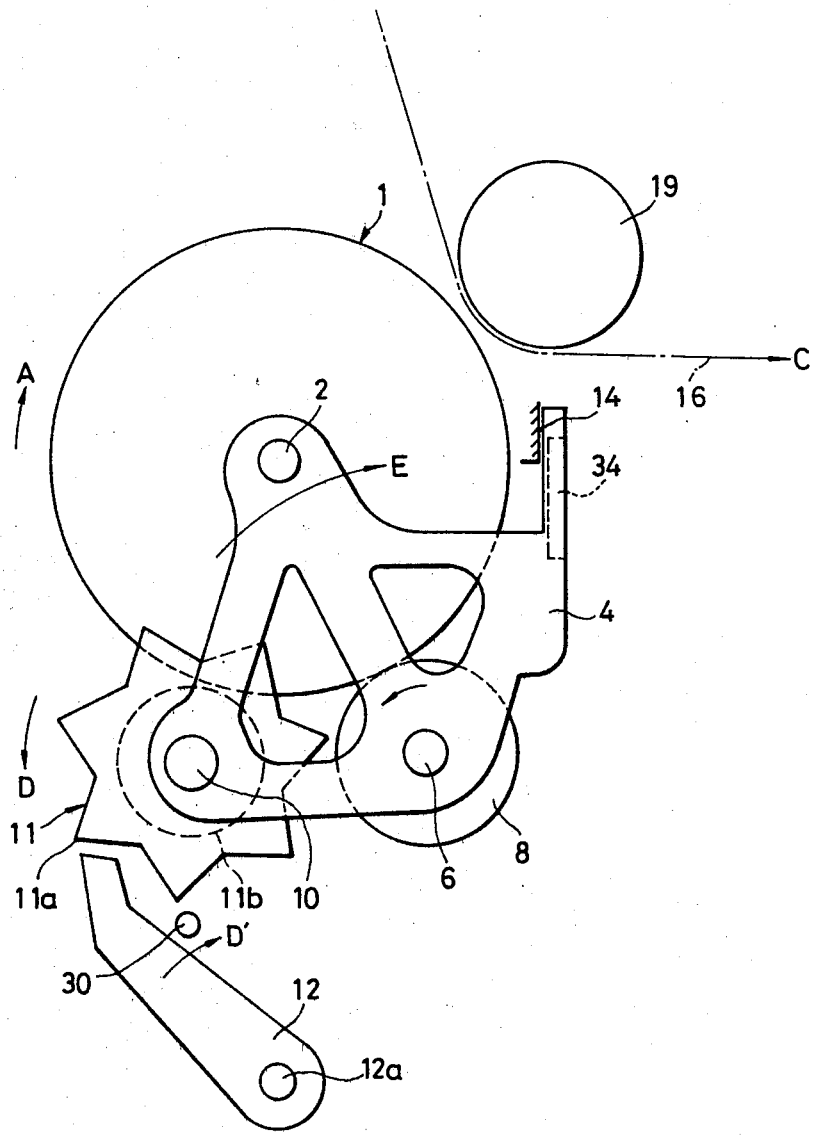
FIG. 3 is a side elevational view of the apparatus as viewed from the left of FIG. 1.

On the other hand, a gear assembly or unit 11 is, as best shown in FIG. 3, rotatably coupled to the left side link member 4 through a shaft 10. The unit 11 includes a ratchet gear 11*a* and a normal gear 11*b* both of which are coaxially secured to each other, the latter gear being always engaged with the gear 1*c* of the drum. A stopper or pawl 12 which is rotatably supported at a shaft 12*a* and is operative to solenoid means (not shown) is positioned so as to enable meshing with a ratchet tooth 11*a* of the ratchet wheel 11. Reference numeral 30 designates a limiter member for the ratchet pawl 12. Thus, the interlock means includes the gear assembly 11, the pawl 12 and the solenoid which is well known in the art, and so the description of the structure thereof may be omitted. Reference numerals 13 and 14 denote stationary abutment portions suitably formed in the printer body frame for the levers 3 and 4 as shown in FIGS. 2 and 3, respectively. Reference numeral 15 denotes an ink roller which at all times abuts against an outer surface of the printing drum so as to feed the helically arranged projections 1*a*′ on the strip 1*a* with ink.

A paper feeding mechanism for feeding papers on which letters or figures are printed will now be described. The above described paper feeding lever 5 having a circular portion 5*d* is rotatably mounted on a rotary shaft 17 supported by the printer body frame and arranged parallel to the drum shaft 2, and a ratchet tooth 5*b* is formed on one side of the circular portion 5*d* of the lever 5. The ratchet tooth 5*b*, as shown in FIG. 1, meshes with a ratchet tooth 18*a* of a ratchet wheel 18 secured to the rotary shaft 17 which is rotatable but not movable with respect to the printer frame, so that one-directional clutch means may be formed by the engagement between the ratchet wheel 18 and the lever 5. A paper feeding roller 19 made of soft elastic material is fixed to the rotary shaft 17, and a printing paper 16 is frictionally engaged with the outer surface of the roller 19. Accordingly, as the roller 19 rotates, the printing paper is fed at a predetermined speed, and it is natural that the roller 19 be positioned on the confronting side to the printing drum.

On the other hand, a projection 5*c* is formed on peripheral surface of the paper feeding lever 5, and a leaf spring 20 is in abutment with the projection 5*c* of the paper feeding lever 5. With the spring force of the leaf spring 20, the lever 5 is biased to rotate around the shaft 17 counterclockwise (in FIG. 2), and also the levers 3 and 4 are biased to move obliquely upward (in FIG. 2) around the shaft 6 through the extension 5*a*, cam surface 1*d*′ and the shaft 2, while the link members 3 and 4 are stopping in abutment with the abutment portions 13 (in FIG. 2) and 14 (in FIG. 3), respectively.

The switch piece 21 is arranged to face the leaf spring 20, and a signal which is generated when the switch strip 21 is separated from the leaf spring 20 may be used as a starting position determining signal by which the printer is operated.

The operation of the apparatus thus constructed will now be described. When the motor M is driven, with the rotational force thereof the printing drum 1 is rotated in the A-direction as shown in FIGS. 2 and 3, and simultaneously therewith the cam member 1*d* is also rotated in the A-direction. With the rotation of the cam member 1*d*, the extension 5*a* is rotated along the cam surface 1*d*′ so that the lever 5 is rotated in the B′-direction (in FIG. 2) overcoming the spring force of the leaf spring 20, and the paper feeding roller 19 is rotated in the B-direction through the engagement of the ratchet teeth 5*b* and 18*a*. When the roller 19 is rotated in the B-direction, the printing paper 16 is continuously fed in the C-direction at a constant speed. After the cam member 1*d* has been rotated by one revolution, the paper is fed a length as shown in FIG. 4.

When the printing drum is rotated to a position where the printing is to be performed, the pawl 12 is rotated in the D′-direction (in FIG. 3) by the solenoid (not shown), to engage the pawl 12 with the ratchet tooth 11*a* and to prevent the gear unit 11 from rotating in the D-direction. At this time, since the gear wheel 1*c* of the drum 1 is engaged with the gear wheel 11*b* of the gear unit 11, the rotation of the gear wheel 1*c* is prevented but the ratchet teeth 11*a* of the gear unit 11 ride over the tip end of the pawl. That is, the link members 3 and 4 are rotated in the printing paper 16 direction, i.e., in the E-direction around the shaft 6, and with this rotational force, one of the projections 1*a*′ of the printing drum 1 abuts against the printing paper 16 interposed between the printing drum 1 and the roller 19 to thereby achieve the suitable printing job. This operation is repeated. When the printing is finished, the biasing energy of the solenoid is released, the pawl 12 escapes out of the ratchet tooth 11*a*, and the printing drum 1 returns to the original position.

Figure 4:
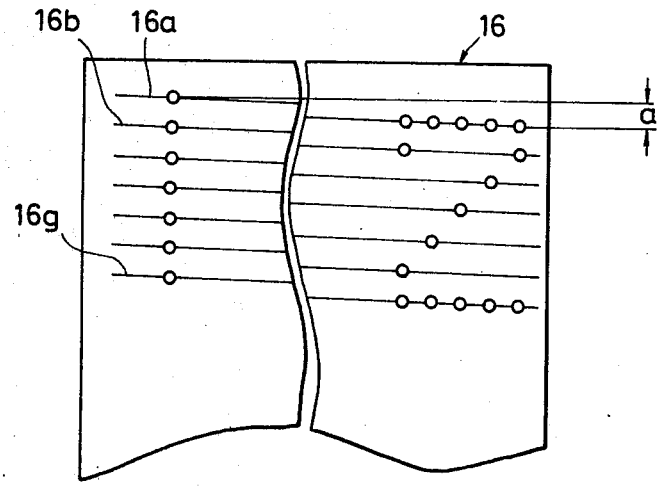
FIG. 4 is an illustration of the printed dots according to the apparatus shown in FIGS. 1 to 3.

Thus, during one rotation of the printing drum 1, a first line 16*a* is printed as shown in FIG. 4. In this case, the printing paper is continuously provided so that the first line 16*a* is slanted by a difference a from the beginning to the end. This slant is negligible in actual use.

When the printing drum 1 is rotated once, the extension 5*a* is pushed into the shouldered portion 1*d*″ of the cam surface 1*d*′ and the engagement between the ratchet teeth 5*b* and 18*a* is displaced by one step, and then the second line 16*b* printing will start. When the extension 5*a* is retracted in the shouldered portion 1*d*″, the leaf spring 20 is separated from the switching piece 21 to thereby produce a signal which may be used for starting position determining signal.

Thus, in the specific embodiment, the printing drum 1 is rotated seven times whereby the printing from the lines 16*a* to 16*g* is achieved. This continuous operation thereby produces a complete one line in actual use.

Figure 5:
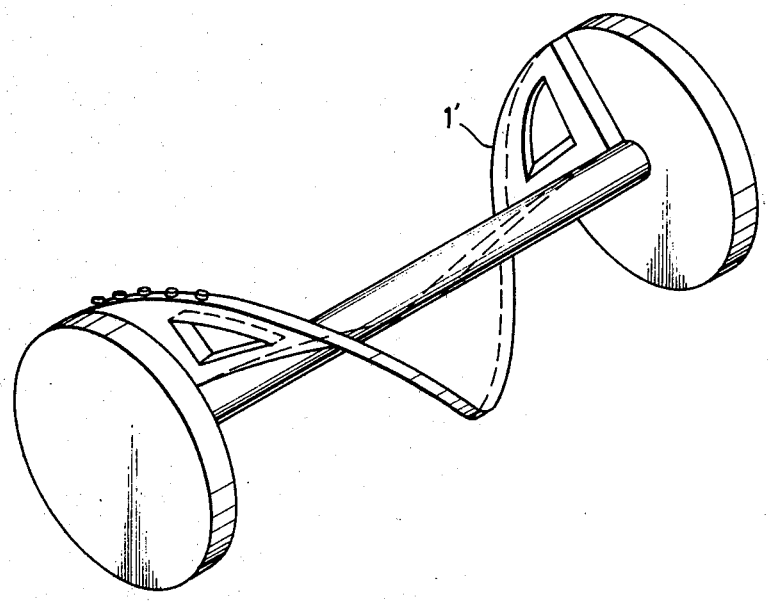
FIG. 5 is a modification showing the printing drum according to the present invention.

FIG. 5 shows another embodiment according to the present invention, in which the skeletonized printing drum 1′ per se is formed in a helical manner. The minimal supporting structure is only required. By use of this form of the printing drum, the weight of the printing drum is effectively decreased to thereby lower the inertia force, leading to an improvement of the responsiveness.

It will be understood that instead of the projection 1*a*′, a letter or a figure may be directly formed as a projection. Also, the above described interlock means may be applied to the right side transmission gear 7.

In a general manner while the present invention is described on the basis of practical and efficient embodiments, it is not limited thereto as there might be changes or modifications made in the arrangement, disposition and form of the parts without departing from the principle of the invention as comprehended within the scope of the appended claims.

What is claimed is:

1. A printing apparatus for printing marks on a printing web comprising:

a printer body frame;

a single rotational drive motor for producing drive rotational force;

rotational force transmission means for transmitting the rotational force;

a drive wheel having a shaft which is rotatably supported to said printer body frame;

spring-biased link means rotatable around said shaft supported by the printer body frame;

printing web feeding means;

a printing drum having a helical one turn member having printing projections thereon, disposed so as to face the printing web, and supplied with the rotational force through said drive wheel at all times, said drum being rotatably mounted on said link means;

and interlock means including a ratchet gear engageable with a ratchet pawl movable in response to solenoid means, said ratchet gear being rotated by the rotational force derived from said drive wheel, whereby when the ratchet gear is engaged with the ratchet pawl operatively moved by said solenoid means, by the rotational force derived from said motor, the ratchet gear is rotated and is slid on said ratchet pawl against the spring force of said link means, and said printing drum is rotated around said shaft of said drive wheel and contacts with the printing web backed-up by said printing means.

2. The printing apparatus according to claim 1, wherein said feeding means includes a printing web feed roller made of elastic soft material, said feed roller being supported by a second rotary shaft supported by the printer body frame.

3. The printing apparatus according to claim 2, wherein said printing drum has a stepped rotary cam member having a shouldered portion, said rotary cam being fixedly coupled to said printing drum, and said printing web feeding means further includes a ratchet wheel mounted on said second rotary shaft and a spring-biased lever member pivotably mounted on said second rotary shaft, engaged with said ratchet wheel at one portion and slidingly following a cam surface of said rotary cam at the other portion whereby when said other portion of said lever member is retracted into said shouldered portion said one portion of said lever member rides over a ratchet tooth of said ratchet wheel to thereby achieve a predetermined feed of the printing web.

4. The printing apparatus according to claim 3, further including a detecting switch for detecting the retraction of said lever member into the shouldered portion of said rotary cam, and for producing an electrical signal at the retraction, to be used for the original position establishment.

5. The printing apparatus according to any one of the preceeding claims, wherein said printing drum consists of helical skeletonized strip member on which a number of printing projections are formed.

* * * * *